US005981161A

United States Patent [19]

Hosoi

[11] Patent Number: 5,981,161

[45] Date of Patent: Nov. 9, 1999

[54] SILVER HALIDE PHOTOGRAPHIC LIGHT SENSITIVE MATERIAL

[75] Inventor: Yuji Hosoi, Hino, Japan

[73] Assignee: Konica Corporation, Japan

[21] Appl. No.: 08/879,840

[22] Filed: Jun. 20, 1997

[30] Foreign Application Priority Data

Jun. 25, 1996 [JP] Japan ..... 8-164538

[51] Int. Cl.[6] ..... G03C 1/035; G03C 1/09; G03C 1/18; G03C 1/34

[52] U.S. Cl. ..... 430/567; 430/605; 430/615; 430/613; 430/614; 430/582; 430/584; 430/585

[58] Field of Search ..... 430/605, 945, 430/567, 615, 613, 614, 582, 584, 585

[56] References Cited

U.S. PATENT DOCUMENTS

| | | | |
|---|---|---|---|
| 5,089,379 | 2/1992 | Yatsuyanagi | 430/434 |
| 5,227,286 | 7/1993 | Kuno et al. | 430/539 |
| 5,294,532 | 3/1994 | Ito et al. | 430/588 |

*Primary Examiner*—Mark F. Huff
*Attorney, Agent, or Firm*—Jordan B. Bierman; Bierman, Muserlian and Lucas

[57] ABSTRACT

A silver halide photographic light sensitive material is diclosed, comprising a support having a silver halide emulsion layer containing cubic silver halide grains containing iodide of 0.1 to 1.0 mol % and an iridium salt of $1\times10^{-8}$ to $1\times10^{-5}$ mol per mol of silver halide and having an area ratio of (100) face to the total grain surface of 80 to 98%; the silver halide emulsion further containing an azaindene compound of not more than 1 mmol per mol of silver halide and being spectrally sensitized with a sensitizing dye represented by formula (I), (II) or (III):

Formula (I)

Formula (II)

Formula (III)

6 Claims, No Drawings

SILVER HALIDE PHOTOGRAPHIC LIGHT SENSITIVE MATERIAL

FIELD OF THE INVENTION

The present invention is related to a silver halide photographic light sensitive material and in particular, to a silver halide photographic light sensitive material which is exposed to an infra-red laser of emitted from He—Ne or a semiconductor element and processed in an automatic processor, and a processing method thereof.

BACKGROUND OF THE INVENTION

Recently, modality for use in medical inspection, such as CT or MRI is often employed in medical care. There is an increasing desire for enhancement of performance of silver halide photographic light sensitive materials used for outputting images photographed by these instruments, and to enhance sharpness of the image, in particular, a photographic material with high contrast is strongly desired.

As one of technique for increasing contrast is known a method of increasing silver coverage. However, this method is not preferable, since it results in marked reduction of contrast in cases when it is rapidly processed over short periods of time of not more than 60 sec or processed at a low developer or fixer replenishing rate.

As another technique for increasing contrast is known a method of reducing a gelatin content used as binder in the photographic material to enhance processability thereof. However, reduction of the binder often produces streak-like fogging (socalled roller marks) when processed in an automatic processor, resulting in undesirable deterioration of pressure resistance.

Recently, as silver halide grain emulsion grains capable of giving highly efficient spectral sensitization, high silver-covering power and high contrast is known tabular silver halide grains. However, the tabular silver halide grains have the disadvantage that the silver image tone is not a neutral black but yellowish one, giving an unpleasant impression of the silver image. Such a phenomenon often occurs with a fine grain emulsion or thin tabular grain emulsion, and an attempt of modification with a toning agent is disclosed. However, application of conventional toning agents to a high sensitive silver halide emulsion results in marked desensitization so that it is not preferred for practical use.

In silver halide photographic light sensitive materials for medical use, an image with a low contrast becomes a flat image, resulting in marked lowering of sharpness. It is usual to finish up a clear image by blackening the background of the images used for such diagnosis. A photographic material with a low contrast lowers the background density, resulting in unacceptable blurred images. Further, bibliographical data such as the patient's name, photographing date and an examining division are usually written onto the film. When a photographic material with low contrast is used, letters are often unclear and therefore hard to read.

In the medical first aid, prompt treatments are indispensable for grasp conditions of a patient so that super rapid treatment system with a total treatment time of 30 sec. is achieved. In addition, there are desired improvements in the processing system, such as reduction of processing effluent by lowering the replenishing rate and minimizing the processing work in terms of environmental protection. Therefore, there is a strong desire for a silver halide photographic light sensitive material in which high sensitivity and high contrast can be consistently achieved even when subjected to rapid processing, neutral black image tone can be obtained and there is no need for concern in terms of environmental protection, and a processing method thereof.

SUMMARY OF THE INVENTION

It is an object of the present invention to provide a silver halide photographic light sensitive material with high sensitivity and high contrast even when rapidly precessed and capable of obtaining a neutral black image tone, and a processing method thereof.

It is a further object of the invention to provide a processing method of a silver halide photographic material in which there are no problems in terms of environmental protection by lowering the replenishing rate of the processing solution.

The above object of the invention can be accomplished by the following constitution.

(1) A silver halide photographic light sensitive material comprising a support having on at least one side thereof a silver halide emulsion layer containing silver halide emulsion, wherein said silver halide emulsion comprises silver halide grains satisfying the following requirements 1 to 3, said silver halide grains being spectrally sensitized with a sensitizing dye represented by formula (I), (II) or (III):

1. cubic silver halide grains having an average odide content of 0.1 to 1.0 mol % and an area ratio of (100) face to the total grain surface of 80 to 98%, 2. a iridium content of $1\times10^{-8}$ to $1\times10^{-5}$ mol per mol of silver halide; and 3. a content of an azaindene compound of not more than 1 mmol per mol of silver halide;

Formula (I)

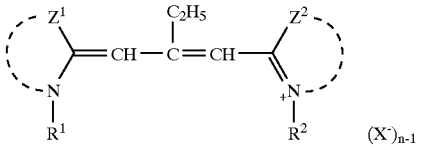

wherein $Z^1$ and $Z^2$ each represent an atomic group necessary for forming a substituted or unsubstituted benzothiazole nucleus, benzoselenazole nucleus, naphthothiazole nucleus or naphthoselenazole nucleus; $R^1$ and $R^2$ each represent a substituted or unsubstituted alkyl group; $X^-$ represents a counter ion; and n is 1 or 2, provided that when an intramolecular salt is formed, n is 1;

Formula (II)

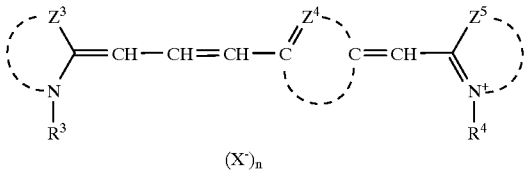

wherein $Z^3$ and $Z^5$ each represent an atomic group necessary for forming a substituted or unsubstituted benzothiazole nucleus, benzoselenazole nucleus, naphthothiazole nucleus or naphthoselenazole nucleus; $Z^4$ represents an atomic group necessary for forming a substituted or unsubstituted, 5 or 6-membered carbon ring; $R^3$ and $R^4$ each represent a substituted or or unsubstituted alkyl group; $X^-$ represents a counter ion; and n is 0 or 1;

Formula (III)

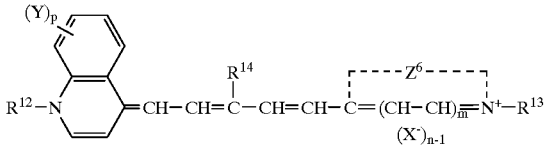

wherein $Z^6$ represents a non-metalic atom group necessary for forming a 5 or 6-membered nitrogen-containing ring; Y represents a halogen atom, an alkoxu group or a substituted or unsubstituted alkyl group having 1 to 8 carbon atoms; $R^{12}$ and $R^{13}$ each represent an alkyl group having 1 to 8 carbon atoms; $R^{14}$ represents a hydrogen atom, an alkyl group having 1 to 8 casrbon atoms, an alkoxy group having 1 to 8 carbon atoms, a phenyl group or a benzyl group; $X^-$ represents a counter ion; and m, n and p each represent 1 or 2, provided that when an intramolecular salt is formed, n is 1.

(2) A method for processing the silver halide photographic light sensitive material described in the above by an automatic processor, wherein a replenishing rate of a developing agent is 25 to 80 mmol per $m^2$ of the photographic material and a total processing time is 10 to 65 sec.

DETAILED DESCRIPTION OF THE INVENTION

Silver halide grains used in the invention have an average iodide content of 0.1 to 1.0 mol %, the silver halide grains being cubic grains having an area ratio of (100) face to the total grain surface of 80 to 98%.

The iodide content of less than 0.1 mol % cannot achieve sufficient sensitivity. When the iodide content is more than 1.0 mol %, the slope in the shoulder of a characteristic curve is decreased, resulting in lowering of contrast. The iodide content of the silver halide grains according to the invention is preferably 0.1 to 1.0 mol % and more preferably 0.1 to 0.6 mol %. Further higher iodide contents disadvantageously result in yellowish black silver images.

The area ratio of (100) face of less than 80% cannot achieve sufficient sensitivity. When the area ratio is more than 98%, the slope in the shoulder of a characteristic curve is decreased, resulting in lowering of contrast. Herein, the expression, "area ratio of (100) face to the total grain surface of 80 to 98% means that, in conventional cases where the grain surface is comprised of (100) face and (111) face, the percentage represented by (100) face/{(100) face+(111) face}×100 is 80 to 98%. The area ratio is preferably 85 to 95% and more preferably 90 to 95%.

The silver halide grains having the area ratio as above can be prepared by a variety of methods. The silver halide grains, for example, can be prepared by simultaneously adding a silver nitrate aqueous solution and a halide aqueous solution while the pAg being maintained at 8.10 or less, socalled controlled double jet method. The pAg is preferable 7.80 or less and more preferably 7.60 or less.

If the course of foming silver halide grains is divided into the nucleation process and growth process, the pAg in the nucleation process is not specifically limited but the pAg in the growth process is preferably 8.10 or less, more preferably 7.80 or less and furthermore preferably 7.60 or less.

The reaction mode of a soluble silver salt and soluble halide salt may be single jet addition or its combination with the double jet addition.

After forming cubic crystal grains, a silver halide solvent such as potassium bromide can be added thereto to cause Ostwald ripening to have the face area according to the invention.

The silver halide photographic light sensitive material according to the invention is provided with a silver halide emulsion layer containing the silver halide grains having the face area ratio as described above. In this case, the emulsion layer preferably contains the silver halide grains having the face area ratio as described above in an amount of 50% by weight or more, more preferably 60% by weight and furthermore preferably 80% by weight or more.

The face area ratio of silver halide grains can be measured by Kubelka-Munk7s dye adsorption method. In this method, used is a dye that is preferentially adsorbed onto either the (100) face or the (111) face and gives a different aggregation state, depending on the face. The area ratio of (100) face to (111) face can be determined by spectrometry after the dye is adsorbed in varied amounts for its addition. Further details of the ratio of the (100) face of the silver halide grain surface are refered to "Identification of the crystal habit of silver halide grains in a photographic emulsion by employing adsorption phenomana of dyes" described by T. Tani in Nihon Kagaku Kaishi (Journal of Chemical Society of Japan), 6, pages 942–946 (1984).

In the silver halide emulsion according to the invention is contained an iridium compound. Examples of the iridium compound include iridium salts, such as $K_3IrCl_6$, $K_2IrCl_6$, $Na_2IrCl_6$ and $K_3IrBr_6$. The iridium content of the silver halide grains is $1\times10^{-8}$ to $1\times10^{-5}$, and preferably $1\times10^{-7}$ to $1\times10^{-5}$ mol per mol of silver halide. The irdium content of less than $10^{-8}$ mol results in insufficient sensitivity and contrast, and it is marked specifically when processed at a low replenishing rate of a developing agent or rapidly processed. Silver image tone is also inferior. Accordingly, to achieve high sensitivity and high contrast, it is necesary to employ the iridium compound within the range of $1\times10^{-8}$ to $1\times10^{-5}$ mol. The iridium compound can be added at any time during the course of preparing the silver halide emulsion, preferably before completing physical ripening and more preferably during forming silver halide grains.

The silver halide emulsion according to the invention contains an azaindene compound. The azaindene compound is contained in an amount of 0 to 0.7 mmol per mol of silver halide, and preferably 0 to 0.5 mmol. In the case of further more amounts, silver image tone is inferior and becomes yellowish. The azaindene compound is added to the emulsion at any time during the course of preparing the silver halide emulsion and preferably at the time of completing chemical ripening.

There are icluded a variety of azaindene compounds usable in the invention. Specifically, a tetrazaindene compound represented by the following formula (T) is preferred.

Formula (T)

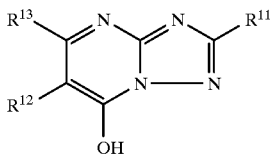

wherein $R^{11}$ represents a hydrogen atom, a carboxylic acid group or its ester group, a mercapto group (icluding one with a substituent), an aryl group (icluding one with a substituent), an alkylthio group (icluding one with a substituent) or an alicyclic group (icluding one with a substituent); $R^{12}$ represents a hydrogen atom, a carboxylic acid group or its ester group, an alkylthio group (icluding one with a substituent), a heterocyclic group (including one with a substituent) or an alicyclic group (icluding one with a substituent); $R^{13}$ represents a hydrogen atom, a hydroxy group, a carboxylic acid group or its ester group, an alkylthio group (icluding one with a substituent), a heterocyclic group (including one with a substituent) or an alicyclic group (icluding one with a substituent), provided that $R^{12}$ and $R^{13}$ may combine with each other to a heterocyclic ring or carbon ring. Exemplary examples of the tetrazaindene compound represented by formula (T) are shown below.

(T-1)

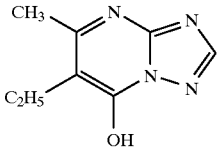

(T-2)

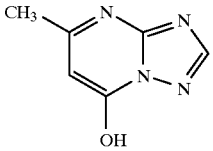

(T-3)

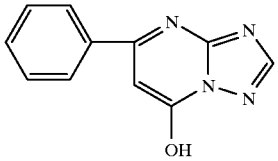

(T-4)

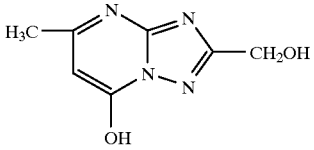

(T-5)

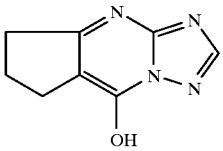

(T-6)

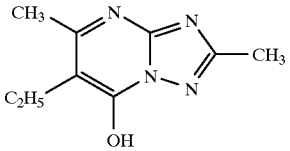

(T-7)

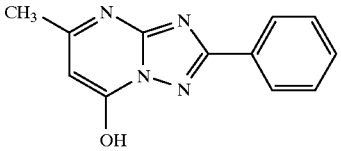

-continued (T-8)

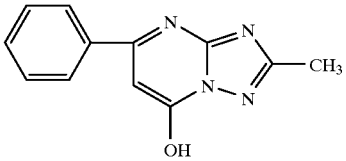

(T-9)

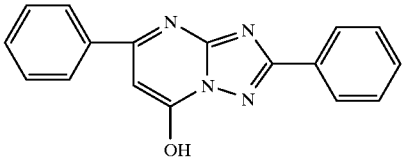

(T-10)

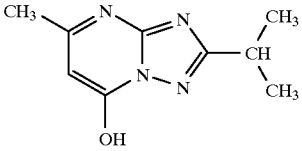

(T-11)

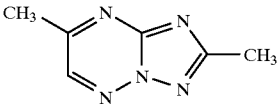

(T-12)

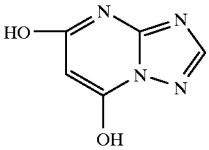

(T-13)

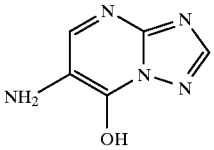

(T-14)

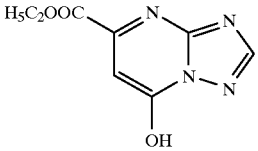

(T-15)

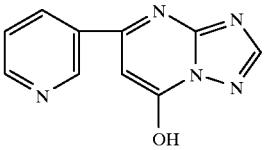

(T-16)

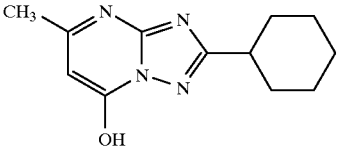

-continued (T-17)

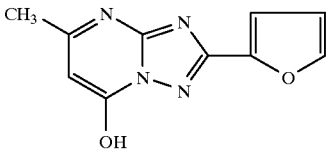

(T-18)

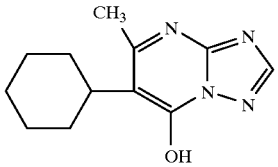

(T-19)

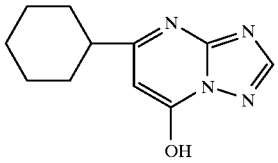

(T-20)

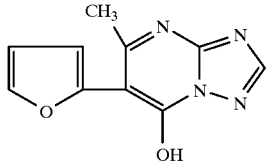

(T-21)

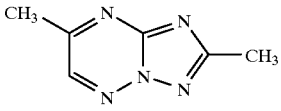

(T-22)

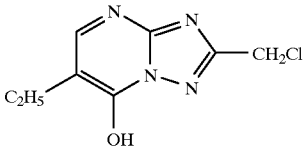

(T-23)

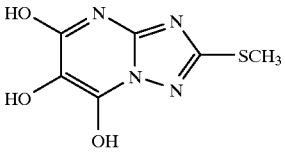

(T-24)

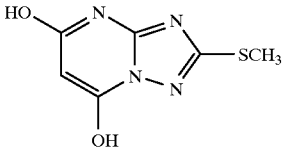

(T-25)

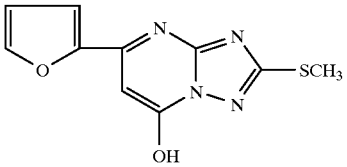

-continued (T-26)

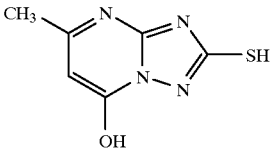

(T-27)

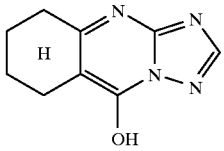

(T-28)

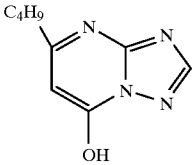

The above compounds can be synthesized according to methods known in the art.

The thus-prepared silver halide emulsion according to the invention is spectrally sensitized with a sensitizing dye represented by formula (I), (II) or (III).

$Z^1$ and $Z^2$ each represent a nonmetalic atom group necessary for forming a substituted or unsubstituted benzothiazole nucleus, benzoselenazole nucleus, naphthothiazole nucleus or naphthoselenazole nucleus. Examples of the benzothiazole nucleus include benzothiazole, 5-chlorobenzothiazole, 5-methylbenzothiazole, 5-methoxybenzothiazole, 5-hydroxy-benzothiazole, 5-hydroxy-6-methylbenzothiazole, 5,6-dimethylbenzothiazole, 5-methoxy-6-methylbenzothiazole, 5-phenylbenzothiazole, 5-carboxybenzothiazole, 5-ethoxycarbonylbenzothiazole, 5-dimethylaminobenzothiazole, and 5-acetylaminobenzothiazole. Examples of the selenazole nucleus include benzoselenazole, 5-chlorobenzoselenazole, 5-methylbenzoselenazole, 5-methoxybenzoselenazole, 5,6-dimethylbenzoselenazole, 5,6-dimethoxybenzoselenazole, 5-ethoxy-6methylbenzoselenazole, 5-hydroxy-6-methylbenzoselenazole, and 5-phenylbenzoselenazole. Example of the naphthothiazole nucleus include β-naphthothiazole and β,β-naphthothiazole. An example of the naphthoselenazole nucleus includes β-naphthoselenazole.

$R^1$ and $R^2$ each represent an alkyl group or substituted alkyl group. Examples thereof include ethyl, n-propyl, β-hydroxyethyl, β-carboxyethyl, γ-carboxypropyl, β-sulfopropyl, γ-sulfopropyl, γ-sulfobutyl, δ-sulfobutyl and sulfoethoxyethyl.

$X^-$ represents a counter ion, including a halide ion, perchlorate ion, thicyanate ion, benzenesulfonate ion, p-toluenesulfonate ion and methylsulfate ion; and n is 1 or 2, provided that when forming an intramolecular salt, n is 1.0049.

The sensitizing dye represented by formula (I) is a thia- or selena-carbocyanine substituted by a ethyl goup in the meso-position of a trimethine chain, exhibiting advantageously spectral sensitization within a specific wavelength region.

The sensitizing dye represented by formula (II) will be explained below.

In the formula, when $Z^4$ forms a 5-membered carbon ring, the sensitizing dye is represented by the following formula (IIa).

Formula (IIa)

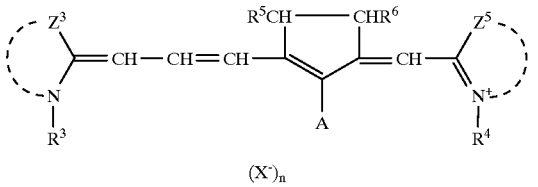

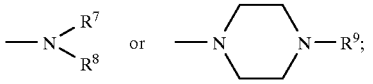

wherein A represents $R^5$ and $R^6$ each represent a hydrogenatom, an alkyl group having 1 to 4 carbon atoms, an alkoxy group having 1 to 4 carbon atoms or a halogen atom (e.g., chlorine atom, bromine atom); $R^7$ and $R^8$ each represent an alkyl group having 1 to 12 carbon atoms, a phenyl group which may be substituted (e.g., phenyl group, m-tolyl group, p-tolyl group, m-chlorophenyl group, p-chlorophenyl group, phenyl group substituted by an methoxy group having 1 to 4 carbon atoms, such as p-methoxyphenyl), 1 to 4 carbon atoms-having alkoxycarbonylalkyl group (e.g., ethoxycarbonylmethyl). $R^9$ represents an alkyl group having 1 to 12 carbon atoms, an alkoxy group having 1 to 4 carbon atoms, 1 to 4 carbon atoms-having alkoxycarbonyl group. $Z^3$, $Z^5$, $R^3$, $R^4$, $X^-$ and n are each the same as defined in formula (II).

In formula (II), when $Z^4$ forms a 6-membered carbon ring, the sensitizing dye is represented by the following formula (IIb).

Formula (IIb)

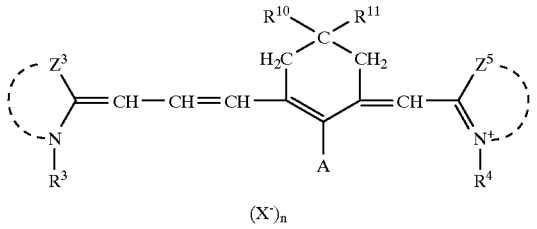

wherein $R^{10}$ and $R^{11}$ each represent a hydrogen atom, an alkyl group having 1 to 4 carbon atoms or a phenyl group; $Z^3$, $Z^5$, $R^3$, $R^4$, $X^-$ and n are each the same as defined in formula (II).

The sensitizing dye represented by formula (III) will be explained below. In formula (III), $R^6$ represents a non-metallic atom group necessary for forming a 5 or 6-membered nitrogen-containing heterocyclic ring. Examples thereof include a thiazole ring, selenazole ring, oxazole ring, quinoine ring, 3,3-dialkylindolenine ring, and imidazole ring. Of these, the thiazole ring and oxazole ring are preferred. In particular, the benzothiazole ring, naphthothiazole ring, benzooxazole ring and naphthooxazole ring are preferred.

Y represents a hydrogen atom, a halogen atom (e.g., chlorine atom, fluorine atom), an alkoxy group and an alkyl group (preferably having 1 to 8 carbon atoms), which may be substituted.

$R^{12}$ and $R^{13}$ each represent an alkyl group (preferably having 1 to 8 carbon atoms), which may be substituted by a substituent. Examples of the substituent include a carboxy group, sulfo group, cyano group, halogen atom (e.g., chlorine atom, bromine atom, fluorine atom), a hydroxy group, alkoxycarbonyl group (preferably having 8 or less carbon atoms), an alkoxy group (preferably having 7 or less carbon atoms), an aryloxy group, an acyloxy group, (preferably having 8 or less carbon atoms), a carbamoyl group, a sulfamoyl group, and an aryl group. $R^{14}$ represents a hydrogen atom, an alkyl group (preferably having 1 to 8 carbon atoms), an alkoxy group (preferably having 1 to 8 carbon atoms), phenyl group or a benzyl group. Of these are preferred an alyl group having 1 to 4 carbon toms and a benzy goup. $X^-$ represents an ion (preferably an acid anion); m,n and p each represent 1 ot 2. When an intramolecular salt is formed, n is 1.

Exemplary examples of sensitizing dyes represented by formula (I), (II) or (III) are shown below, but the present invention is not limited to these examples.

I-1

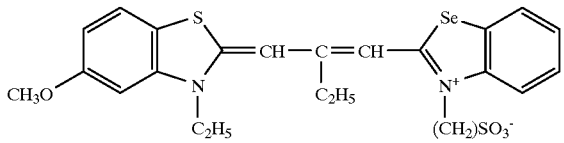

I-2

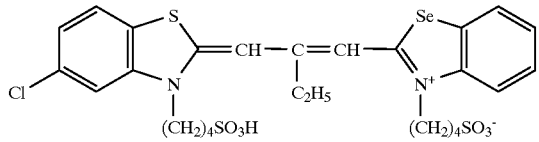

-continued
I-3
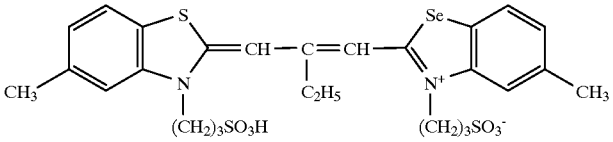
I-4
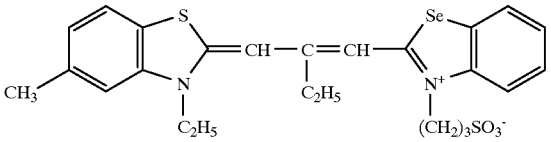
I-5
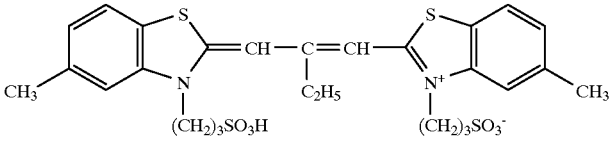
I-6
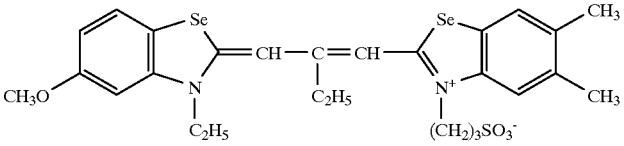
I-7
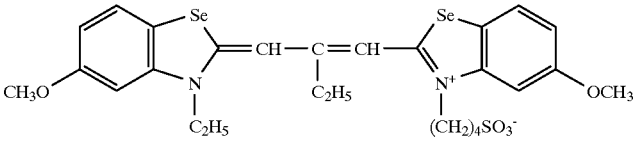
III-4
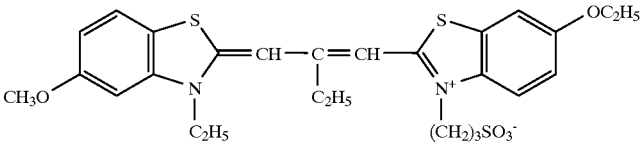
I-9
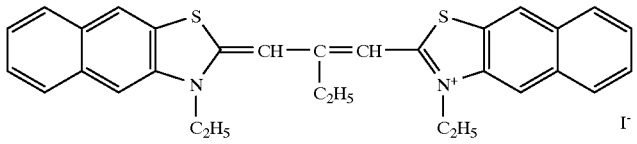
I-10
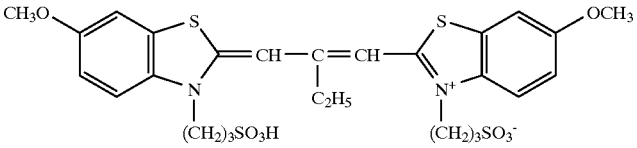
I-11
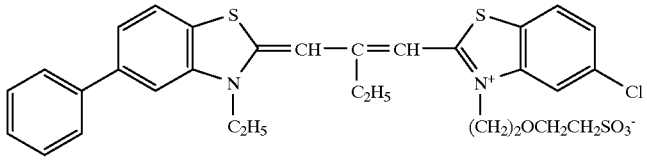

-continued
I-12
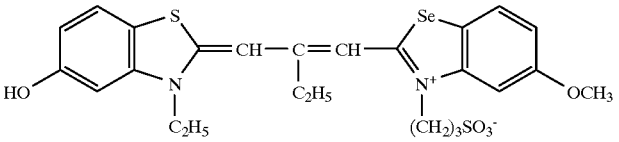
I-13
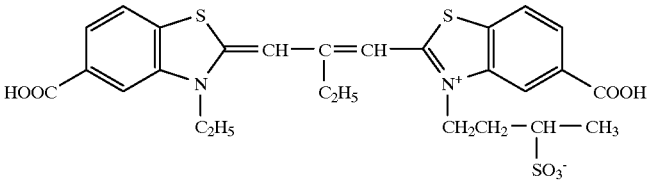
I-14
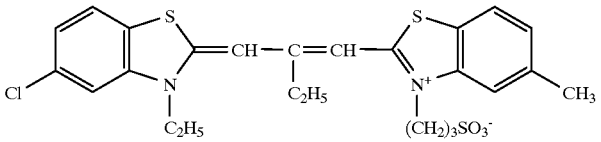
I-15
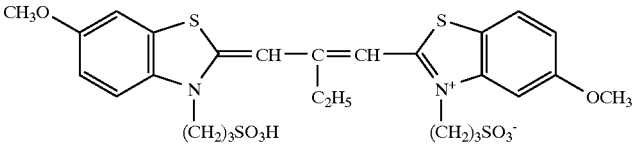
I-16
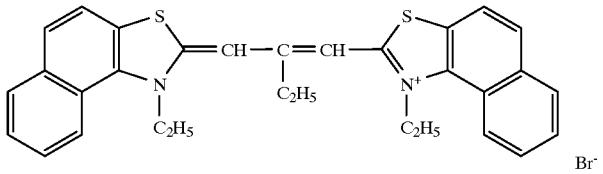
I-17
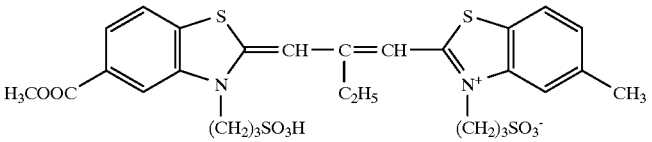
I-18
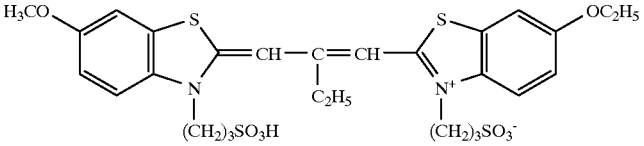
I-19
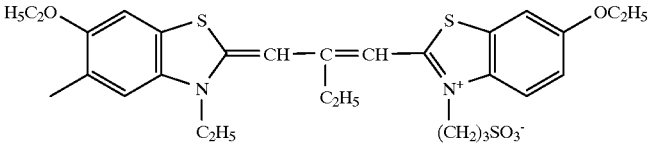
I-20
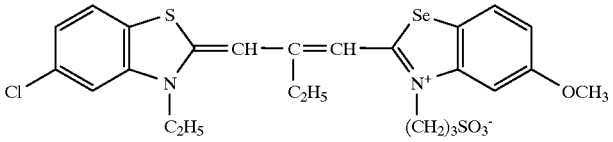

-continued
I-21
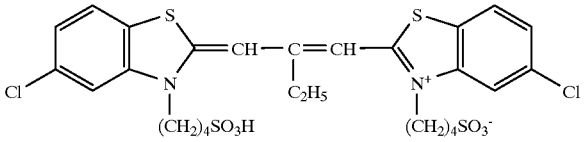
I-22
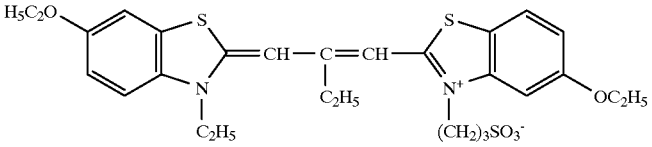
I-23
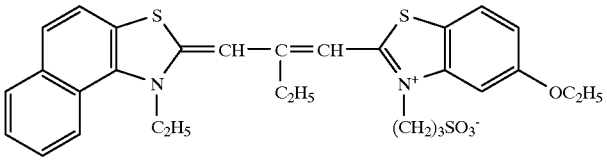
I-24
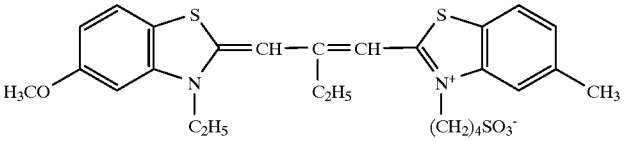
I-25
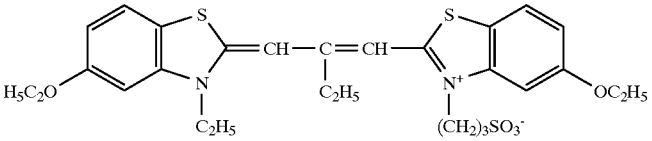
I-26
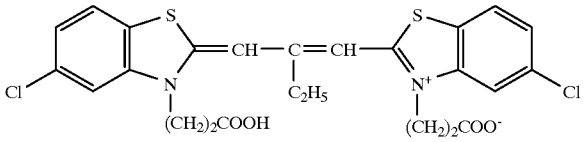
I-27
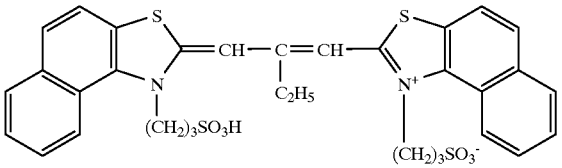
I-28
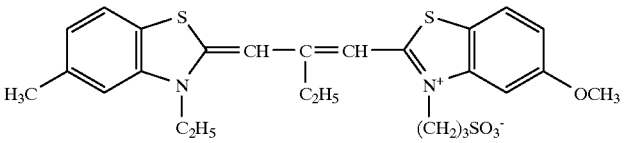
I-29
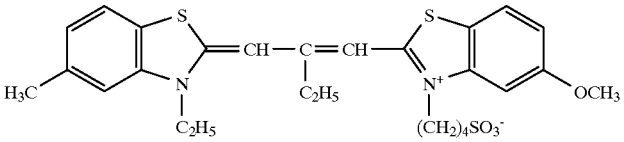

-continued
I-30
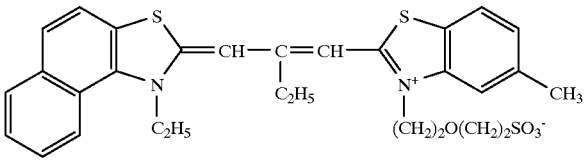
I-31
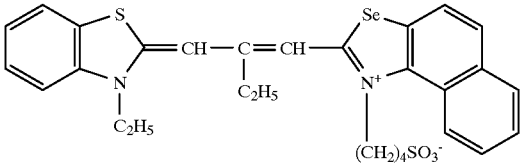
I-32
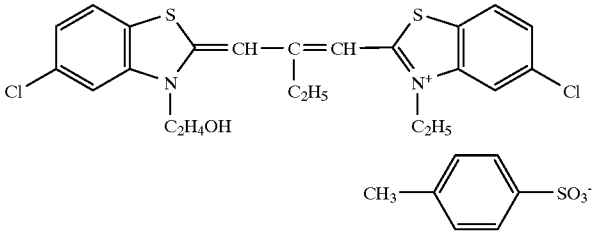
I-33
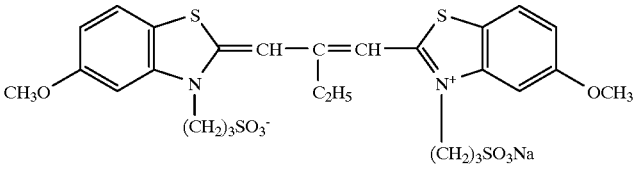
I-34
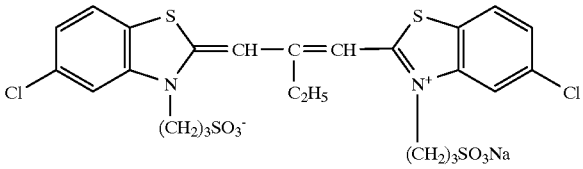
I-35
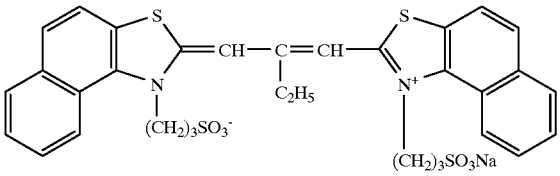
II-1
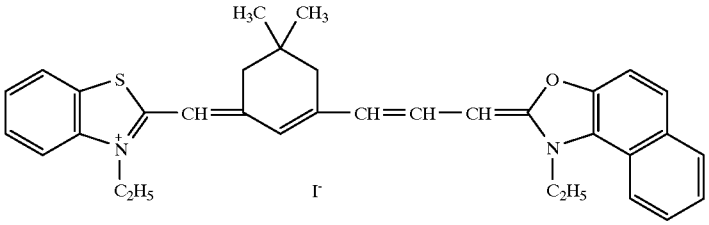

-continued
II-2
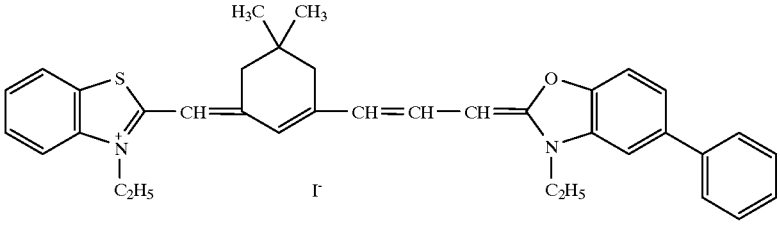
II-3
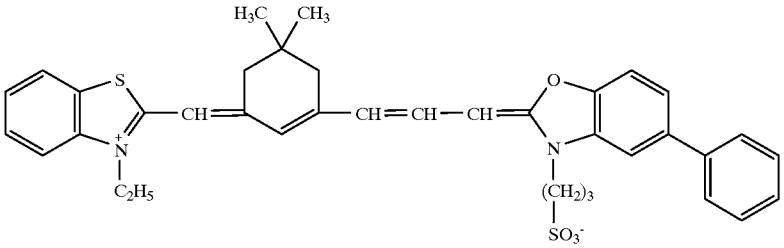
II-4
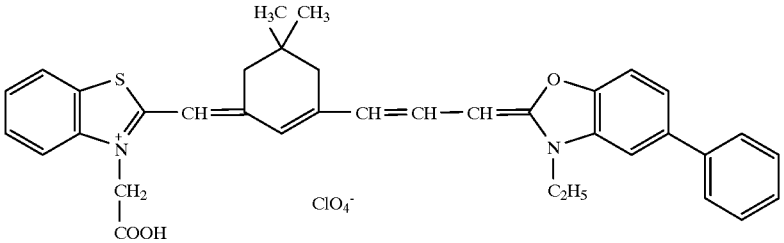
II-5
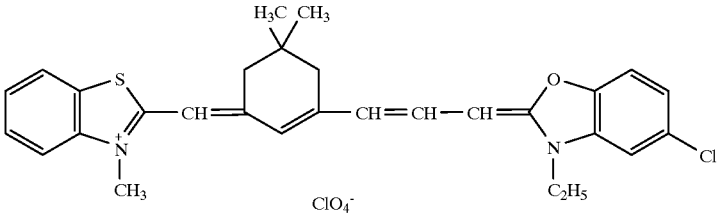
II-6
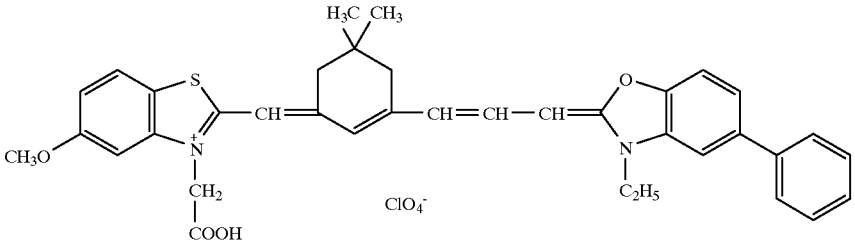
II-7
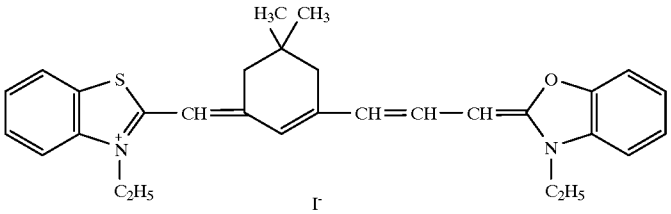

-continued
II-8
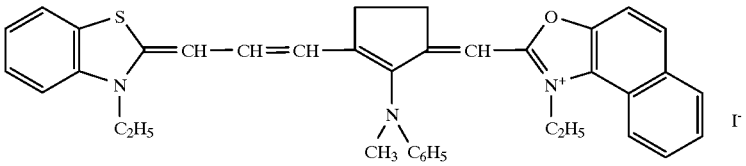
II-9
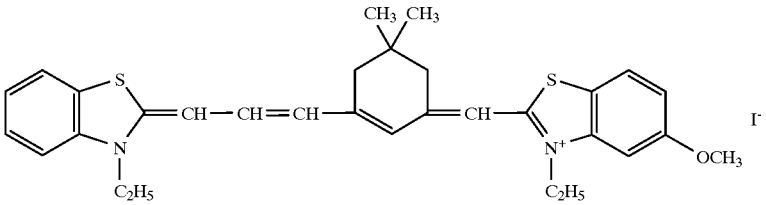
II-10
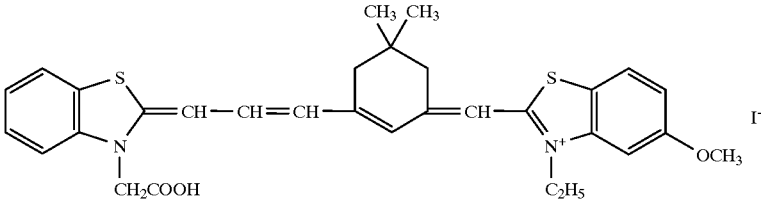
II-11
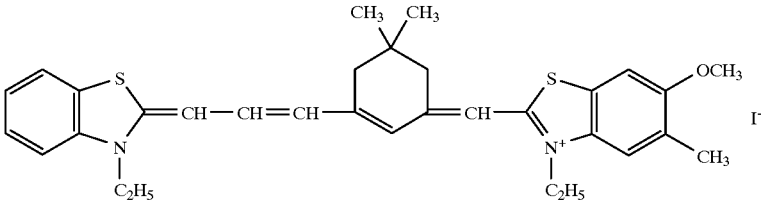
II-12
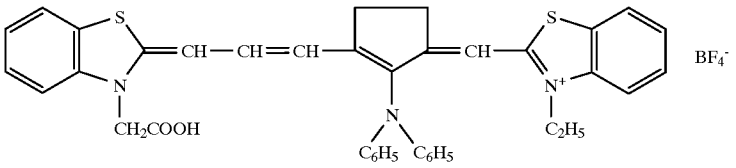
II-13
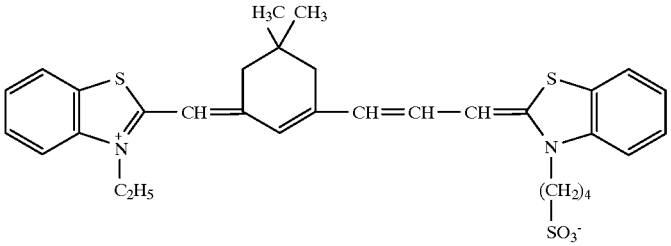
II-14
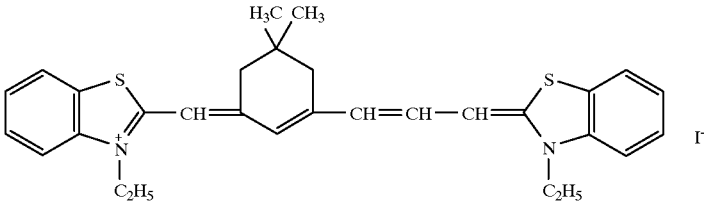

-continued
II-15
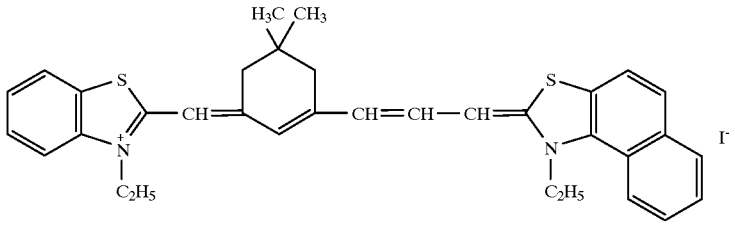
II-16
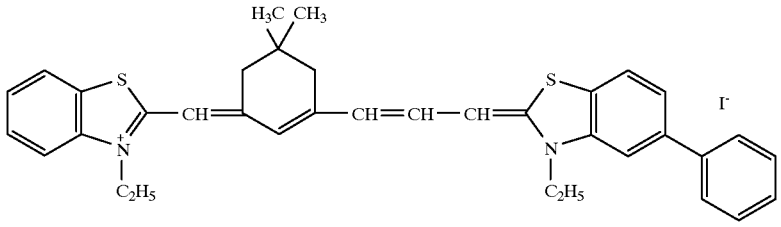
III-1
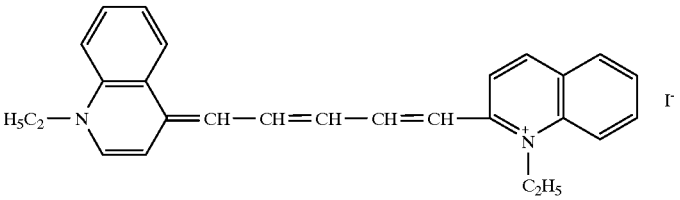
III-2
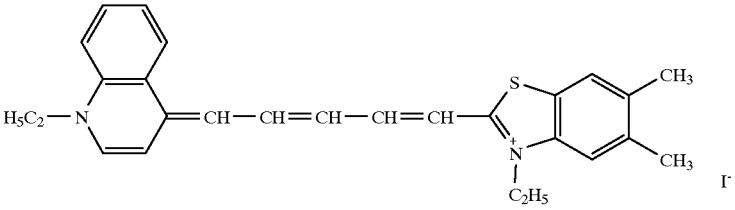
III-3
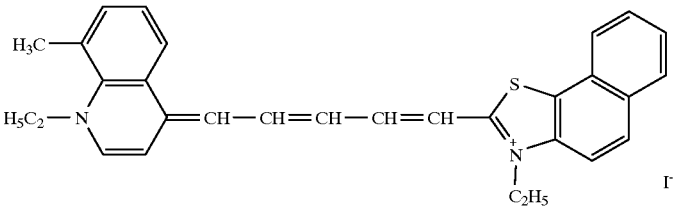
III-4
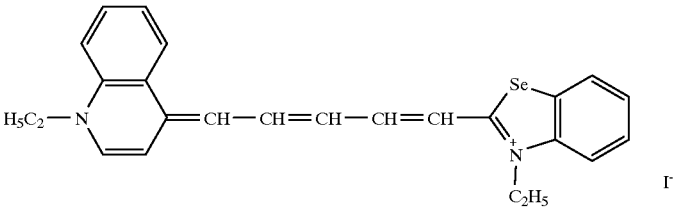

-continued
III-5
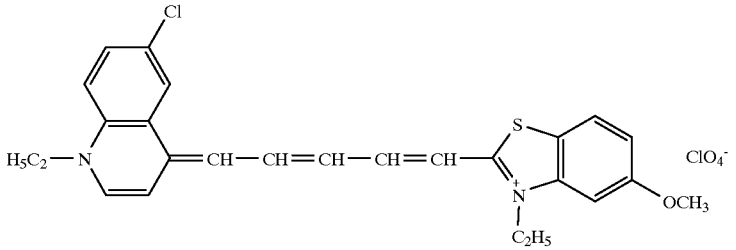
III-6
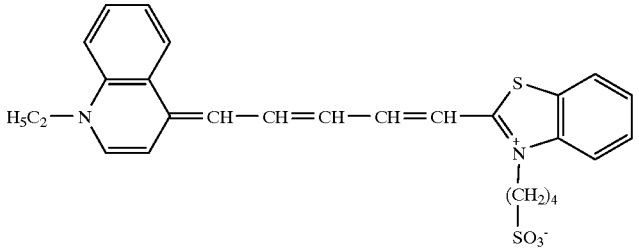
III-7
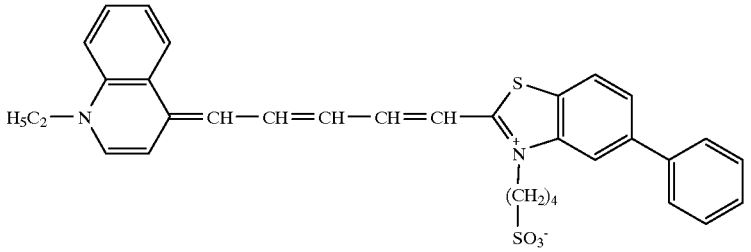
III-8
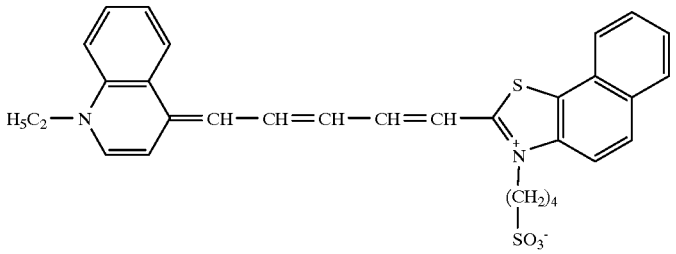
III-9
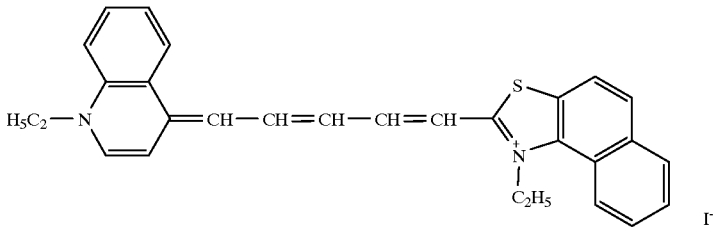
III-10
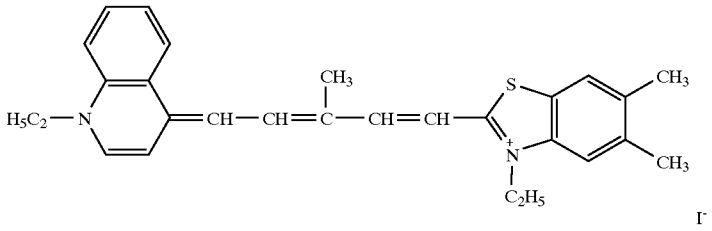

The sensitizing dye represented by formulas (I) to (III) can readily be synthesized according to methods described in F. M. Hamer, The Chemistry of Heterocyclic Compound Vol.18.

The sensitizing dye represented by formulas (I) to (III) is preferably incorporated in an amount of 0.003 to 0.3 g and more preferably 0.005 to 0.15 g per mol of silver halide. The dye is incorporated through dissolving in an appropriate solvent such as methanol, ethanol, methyl cellosolve, acetone, water or a mixture thereof. The sensitizing dye can be dissolved by means of an ultrasonic homegenizer. The sensitizing dye can also be incorporated according to methods described in U.S. Pat. Nos. 3,469,987 and 3,822,135, JP-B 46-24185 (the term, "JP-B" means examined and published Japanese Patent), JP-A 50-80826, and 51-74624. Further, the sensitizing can be incorporated in the form of a solid particle dispersion. There can be obtained desired sensitivity by using the sensitizing dye singly. The sensitizing dye can also be used in combination. In this case, a mixing ratio is optional. The sensitizing dye can be used in combination with another kind of sensitizing dyes known in the art. The sensitizing dye can be added to the emulsion at any time from before completing the desalting process to immediately before completing the chemical ripening process. The dye is preferably added at the time of chemical ripening, more preferably, at the start of chemical ripening.

The silver halide emulsion used in the invention preferably comprises silver halide cubic crystal grains. The emulsion can be employed singly or in a blended form. In this case, either emulsion may be chemically unsensitized (or primitive) one.

The silver halide emulsion used in the invention is preferably monodisperse, and a variation coefficient of grain size is preferably not more than 25%. The average grain size of the emulsion is preferably 0.05 to –0.7 μm and more preferably 0.15 to 0.25 μm. The grain size is referred to as a sphere-equivalent diameter (i.e., diameter of a sphere having the same volume as the grain).

Silver halide grains contained in the emulsion may have homogeneous halide composition or contain localized iodide. Internally iodide containing core/shell type grains are preferably employed. The core/shell type grain emulsion can be prepared according to methods described in JP-A 59-177535, 59-178447, 60-35726 and 60-147727. The silver halide emulsion can be desalted to remove soluble salt by a noodle washing method or flocculation washing method. As preferred washing method are cited a technique of employing an aromatic hydrocarbon type aldehyde resin containing a sulfo group described in JP-B 35-16086 and a technique of employing and polymeric coagulating agent (exemplified G3 and G8) described in JP-A 63-158644.

To the silver halide emulsion, a variety of photographic adjuvants can be during the course of physical ripening and chemical ripening. As the adjuvants are cited compounds described in Research Disclosure (RD) No.17643 (December, 1978), ibid 18716 (November, 1079) and ibid 308119 (December, 1989). Described portions are shown below.

| | RD-17643 | | RD-13716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–3 | IVA |

-continued

| | RD-17643 | | RD-13716 | RD-308119 | |
|---|---|---|---|---|---|
| Additive | Page | Sec. | Page | Page | Sec. |
| Desensitizing dye | 23 | IV | | 998 | IVB |
| Dye | 25–26 | VIII | 649–650 | 1003 | VIII |
| Developing accelerator | 29 | XXI | 648 upper right | | |
| Antifoggant/stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 26–27 | XI | 650 right | 1005–6 | XI |
| Antistatic agent | 27 | XII | 650 right | 1006–7 | XIII |
| Plasticizer | 27 | XII | 650 right | 1006 | XII |
| Slipping agent | 27 | XII | | | |
| Matting agent | 28 | XVI | 650 right | 1008–9 | XVI |
| Binder | 26 | XXII | | 1003–4 | IX |
| Support | 28 | XVII | | 1009 | XVII |

The photographic material according to the invention can be processed using processing solutions described in RD-17643, XX–XXI, pages 29–30 and RD 308119, XX–XXI, page 1011–1012.

Examples developing agents used in black-and-white photographic processing include dihydroxybenzenes (e.g., hydroquinone), 3-pyrazolidones (e.g., 1-phenyl-3-pyrazolidone), aminophenols (e.g., N-methyl-p-aminophenol) and reductones. These can be used singly or in combination.

The photographic material according to the invention can be processed by an automatic processor, in which a replenishing rate of a developing agent is preferably 25 to 80 and more preferably 35 to 60 mmol per $m^2$ of the photographic material. The replenishing rate of a developing agent of less than 25 mmol results in lowering of contrast and deterioration of image color tone, particularly when rapidly processed over a short period. The replenishing rate of processing solutions which is as less as possible, is preferred in terms of environmental protection and running cost.

A developing solution (including its replenisher) can optionally contain an adjuvant known in the art, such as a preservative, alkali agent, pH buffering agent, hardener, development-accelerating agent, surfactant, defoaming agent, toning agent, water-softening agent, dissolving-aid, or thickener.

A fixing solution contains a thiosulfate or thiocyanate as a fixing agent, and further contains water-soluble aluminum salt as a hardener, such as aluminum sulfate or potassium alum. In addition thereto, a preservative, pH adjusting agent or water-softening agent may be contained.

The photographic material according to the invention is processed by roller-transport type automatic processor for a total processing time of 10 to 65, preferably 15 to 45 sec. The expression, "total processing time within 65 sec" means that a total process from developing to drying is completed within 65 sec. Thus, a period of time from the time when a top of the photographic material is dipped in a developing solution to the time when the top passes through various processing steps and comes out of a drying zone (so-called Dry to Dry time) is within 65 sec. and preferably 45 sec. The developing time is preferably 5 to 45 and more preferably 8 to 30 sec. The developing temperature is preferably 25 to 50 and more preferably 30 to 40° C.. The fixing time and temperature are preferably 6 to 20 sec, and 20 to 50° C., respectively and more preferably 6 to 15 sec and 30 to 40° C.. In the processor is provided a drying zone in which heated air with a temperature of 35 to 100° C., preferably, 40 to 80° C. is sprayed or a heating means by far-infrared radiation is provided.

There may be employed a processor provided with a mechanism of providing water or an acidic, non-fixable rinsing solution between steps of developing, fixing and washing. There may further be built-in a device for preparing a developing or fixing solution.

EXAMPLES

The present invention will be explained further in detail based on examples, but the invention is not limited to these examples.

Example 1

Preparation of Chemical-ripened Emulsion

Using a silver bromide seed grain emulsion with an average grain size of 0.1 μm were mixed an ammoniacal silver nitrate aqueous solution and a solution of potassium bromide and potassium iodide containing $K_2IrCl_6$ in an amount as shown in Table 1 by double jet addition to obtain a monodisperse silver iodobromide cubic grain emulsion with an average grain size of 0.25 μm. During grain growth, the pAg was optimally adjusted to not more than 8.1 so as to have an area ratio of (100) face to the total grain surface, as shown in Table 1. After completing addition, the pH was adjusted to 6.0 and the resulting emulsion was desalted by coagulation-washing by using an aqueous solution of Demol N (product by Kao-Atlas) and a magnesium sulfate aqueous solution. Further thereto was added 23 g of ossein gelatin to redisperse the washed emulsion. The silver potential and pH were respectively 50 mV and 5.85 at 50° C. 200 silver halide grains were taken out, on an arbitrary basis, from the emulsion and observed by an electron microscope to measure grain sizes. A variation coefficient of grain size was proved to be 0.15. The area ratio of (100) face was determined by Kubelluka-Munk method described in Nihon Kagakukaishi, vol. 6, 942–946 (1984).

To the thus prepared emulsion, the following sensitizing dyes according to the invention were added in combination and chemical ripening was carried out at 50° C. by adding 1% $NH_4SCN$ solution of 5.2 ml, 0.2% $HAuCl_4$ of 0.78 ml and 0.25% $Na_2S_2O_3$ of 5.6 ml, 0.4% and triphenylphosphine selenide solution of 3.5 ml, each per mol of silver. KBr of 300 mg per mol of silver was added at the time when a fog density reached 0.02 and after adding an azaindene compound (4-hydroxy-6-methyl- 1,3,3a,7-tetrazaindene) was added in an amount as shown in Table 1, the temperature was lowered to stop chemical ripening.

Sensitizing dye:

| | |
|---|---|
| I-33 | 50 mg/Ag mol |
| I-34 | 15 mg/Ag mol |
| I-35 | 100 mg/Ag mol |

To each of above chemically ripened emulsions was added an unripened emulsion prepared as described below, in a ratio of the ripened emulsion to the unripened one of 9:1.

Preparation of ripened emulsion

Using a silver bromide seed grain emulsion with an average grain size of 0.3 μm was prepared monodisperse emulsion with an average grain size of 1.1 μm and a variation coefficient of grain size of 0.15, by ammoniacal precipitation.

Compounds described below were added to the emulsion to prepare an emulsion coating solution. The amount shown below is represented as per mol of silver.

| | |
|---|---|
| 1-Phenyl-5-mercaptotetrazole | 10 mg |
| 1-Trimethylolpropane | 14 mg |
| t-Butylcatechol | 68 mg |
| Polyvinyl pyrrolidone (M.W. 10,000) | 850 mg |
| Styrene-anhydrous maleic acid copolymer | 2.0 g |
| Nitrophenyl-triphenyl-phosphonium chloride | 50 mg |
| ammonium 1,3-dihydroxybenzene-4-sulfonate | 1.7 g |
| 1,1-Dimethyl-1-bromo-1-nitrmethane | 6.2 mg |
| $n\text{-}C_4H_9OCH_2CH(OH)CH_2N(CH_2COOH)_2$ | 700 mg |
| 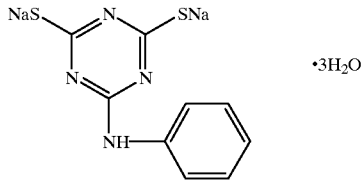 $\cdot 3H_2O$ | 42 mg |
| 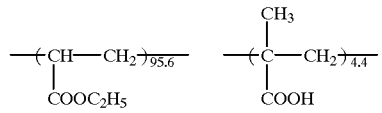 MW: 20000 | 18 g |
| 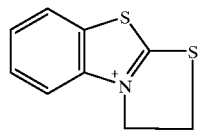 $CH_3SO_3^-$ | 28 mg |

A coating solution of a protective layer was prepared by adding the following compounds to gelatin aqueous solution. The addition amount is represented as per g of gelatin.

| | |
|---|---|
| Matting agent of polymethyl methacrylate (av. particle size: 5 μm) | 21 mg |
| Matting agent of polymethyl methacrylate (av. particle size: 3 μm) | 28 mg |
| 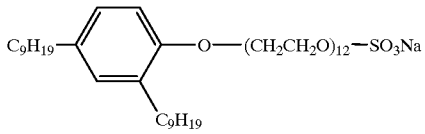 | 20 mg |

-continued

| | |
|---|---|
| 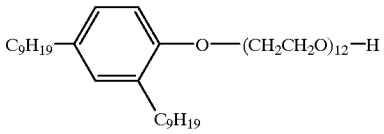 | 7 mg |
| 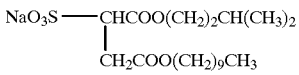 | 7 mg |
| $C_{12}H_{25}CONH(CH_2CH_2O)_5H$ | 62 mg |
| 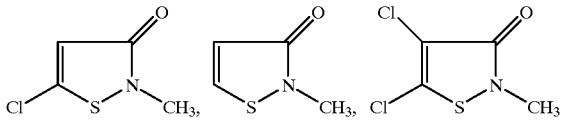 (50:46:4) | 0.9 mg |
| Hardener H | 100 mg |

Preparation of Backing Layer

| | |
|---|---|
| Gelatin | 100 g |
| Anti-halation dye as shown below | 4 g |
| Potassium nitrate | 1 g |
| Glyoxal | 2 g |
| water | 1400 ml |
| Hardener H | |

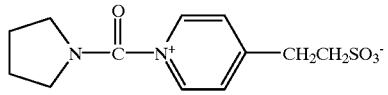

Anti-halation dye

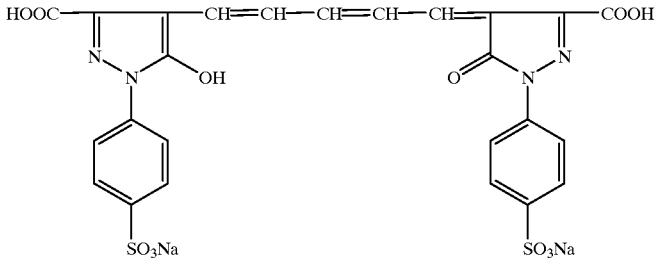

Preparation of Backing Protective Layer

| | |
|---|---|
| Gelatin | 100 g |
| Matting agent of polymethyl methacrylate (av. particle size: 6 μm) | 3 g |
| $C_{13}H_{23}CONH(CH_2CH_2O)_5H$ | 10 g |
| Hardener H | 10 g |

The above coating solutions of emulsion layer, protective layer, backing layer and backing protective layer were simultaneously coated on a subbed base film to prepare a photographic material sample. Silver coverage of emulsion layer-side was 2.0 g/m$^2$. The gelatin coating amount of emulsion layer-side was 1.5 g/m$^2$ of the emulsion layer and 0.5 g/m$^2$ of the protective layer. The gelatin coating amount of backing layer-side was 1.5 g/m$^2$ of the backing layer and 0.5 g/m$^2$ of the backing layer-side.

Prepared samples each were processed using the following developing solution and fixing solution, and evaluated.

Developing solution

Part-1

| | |
|---|---|
| Hydroquinone | 32 g |
| 4-Hydroxymethyl-4-methyl-1-phenyl-3-pyrazolidone | 4 g |
| 1-Phenyl-5-mercaptotetrazole | 0.06 g |
| 5-nitrobenzimidazole | 0.02 g |

-continued

| | |
|---|---|
| iso-Ascorbic acid sodium salt | 1.6 g |
| Sodium sulfite | 21.7 g |
| Potassium sulfite | 104 g |
| Boric acid | 5 g |
| Sodium hydrogencarbonate | 20 g |
| Potassium hydroxide | 92.3 g |
| Diethylenetriaminepentaacetic acid | 5 g |
| Diethylene glycol | 85 g |
| Water | 270 g |

Part-2

| | |
|---|---|
| Acetic acid (90%) | 21.7 g |
| 1-Phenyl-3-pyrazolidone | 2 g |
| Triethylene glycol | 13 g |
| n-Acetyl-D,L-penicillamine | 0.2 g |
| Water | 8.35 g |

Part-3

| | |
|---|---|
| Glutar aldehyde (50% aqueous solution) | 4 g |
| Water | 16.7 g |

Above three Parts were mixed with adding water to make 1 liter. The prepared developing solution was introduced into a developing bath and used as a working solution.

Fixing Solution

| | |
|---|---|
| Ammonium thiosulfate (70 wt %/vol %) | 52.0 g |
| Sodium sulfite | 6.0 g |
| Sodium acetate | 32.19 g |
| boric acid | 9 g |
| Tartaric acid | 2.3 g |
| $KAl(SO_4)_2 12H_2O$ | 1.7 g |
| β-Alanine | 14 g |
| Water | 305.5 ml |

Water was further added to the above composition to make 1 liter of a fixing solution. The prepared solution was introduced into a fixing bath and used as a working solution.

The pH was adjusted to 4.2 using acetic acid or sodium acetate. As a processor to be employed, processor SRX-503 (produced by Konica) was modified so as to meet the following processing speed.

Process

| Step | Temp. (° C.) | Time (sec) |
|---|---|---|
| Insertion | — | 0.7 |
| Developing and crossover | 35 | 8.0 |
| Fixing and crossover | 33 | 5.8 |
| Washing and crossover | 18 | 3.6 |
| Squeezing | 40 | 2.5 |
| Drying | 50 | 4.3 |
| Total | — | 24.9 |

Volumes of each processing bath of the processor were 16 liters of a developing bath, 10 liters of a fixing bath and 10 liters of a washing bath. 200 g of clinka 205 (produced by Hiita Lab.) was packed in a package made of polyethylene textile with 20-mesh and dipped in the vicinity of water-supplier of a washing bath. Drying was conducted by employing an infrared ray heater (heating temperature: 220° C.) and heated air (60° C.) in combination. Insertion of films was detected by means of infrared ray sensor.

Replenishing rates of the developing solution and fixing solution were respectively 50 mmol/$m^2$, as developing agent and 150 mmol/$m^2$, as fixing agent.

Sensitometric Evaluation

Using a laser scanner having a light source of a semiconductor laser with a wavelength of 670 nm, photographic material samples each were subjected to exposure by varying stepwise exposure energy and processed according to the above conditions. Sensitivity was shown as a relative value of a reciprocal of exposure energy giving a density of fog plus 1.0, based on the sensitivity of Sample 3 being 100. Gradation (γ) was shown as a slope which was obtained by dividing 2.25 by difference between logarithmic exposure energy giving a density of fog plus 2.5 and that of fog plus 0.25.

Evaluation of Silver Image Tone

Samples each were evaluated with respect to silver image tone after exposed so as to give a density of 1.0 and processed.

The silver image tone was evaluated based on the following five grades:

1: Markedly yellowish image

2: Yellowish

3: Apparently yellowish

4: Slightly yellowish

5: Neutral black

Of these, grades 1 and 2 are unacceptable level to the market; grade 3 is a minimum level acceptable to the market; and grade 5 represents superior level. Evaluation was made by four referees and the result was shown as an average value.

Results thereof are shown in Table 1.

TABLE 1

| Sample No. | I Content (mol %) | Ir Content (mol/mol Ag) | (100) ratio (%) | AZAINdene compound (mol/mol Ag) | Sensitivity | γ | Silver image tone | Remark |
|---|---|---|---|---|---|---|---|---|
| I-1 | 2 | 0 | 95 | T-2 (6) | 110 | 1.4 | 2 | Comp. |
| I-2 | 1 | $1 \times 10^{-6}$ | 95 | T-2 (6) | 105 | 1.8 | 2 | Comp. |
| I-3 | 0.5 | $1 \times 10^{-6}$ | 95 | T-2 (6) | 100 | 2.0 | 2 | Comp. |
| I-4 | 0.i | $1 \times 10^{-6}$ | 95 | T-2 (6) | 98 | 2.1 | 2 | Comp. |
| I-5 | 0.5 | 0 | 95 | T-2 (6) | 85 | 1.5 | 2 | Comp. |
| I-6 | 0.5 | $1 \times 10^{-6}$ | 85 | T-2 (6) | 92 | 2.0 | 2 | Comp. |
| I-7 | 0.5 | $1 \times 10^{-6}$ | 75 | T-2 (6) | 80 | 2.0 | 2 | Comp. |
| I-8 | 0.5 | $1 \times 10^{-6}$ | 100 | T-2 (6) | 100 | 1.5 | 2 | Comp. |
| I-9 | 0.5 | $1 \times 10^{-6}$ | 95 | T-2 (2) | 105 | 2.0 | 2.25 | Comp. |
| I-10 | 0.5 | $1 \times 10^{-6}$ | 95 | T-2 (1) | 106 | 2.0 | 3.5 | Inv. |
| I-11 | 0.5 | $1 \times 10^{-6}$ | 95 | T-2 (0.5) | 106 | 2.1 | 4.5 | Inv. |
| I-12 | 0.5 | $1 \times 10^{-6}$ | 95 | T-4 (0.5) | 106 | 2.1 | 4.5 | Inv. |
| I-13 | 0.5 | $1 \times 10^{-6}$ | 95 | T-12 (0.5) | 105 | 2.1 | 4.75 | Inv. |
| I-14 | 0.5 | $1 \times 10^{-6}$ | 95 | T-12 (0.5) | 108 | 2.1 | 5 | Inv. |

As can be seen from the Table, inventive samples were proved to have high sensitivity and high contrast (γ) even when subjected to rapid processing and be superior in silver image tone.

Example 2

Samples II-1 to 14 were prepared in the same manner as in Example 1, except that sensitizing dyes were replaced by exemplified dye II-10 (100 mg/Ag mol). Further, the antihalation dye employed was also replaced by dye II-10.

Using a laser imager having a light source of a semiconductor laser with a wavelength of 780 nm, samples each were subjected to exposure by varying stepwise exposure energy and processed, and the sensitivity and γ were determined in the same manner as in Example 1. The sensitivity was shown as a relative value, based on the sensitivity of Sample II-3 being 100. Silver image tone of each sample was also evaluated in the same manner as in Example 1. Results thereof are summarized in Table 2.

TABLE 2

| Sample No. | I Content (mol %) | Ir Content (mol/mol Ag) | (100) ratio (%) | AZAINdene compound (mol/mol Ag) | Sensitivity | γ | Silver image tone | Remark |
|---|---|---|---|---|---|---|---|---|
| II-1 | 2 | 0 | 95 | T-2 (6) | 112 | 1.4 | 2 | Comp. |
| II-2 | 1 | $1 \times 10^{-6}$ | 95 | T-2 (6) | 106 | 1.8 | 2 | Comp. |
| II-3 | 0.5 | $1 \times 10^{-6}$ | 95 | T-2 (6) | 100 | 2.0 | 2 | Comp. |
| II-4 | 0.1 | $1 \times 10^{-6}$ | 95 | T-2 (6) | 98 | 2.1 | 2 | Comp. |
| II-5 | 0.5 | 0 | 95 | T-2 (6) | 85 | 1.5 | 2 | Comp. |
| II-6 | 0.5 | $1 \times 10^{-6}$ | 85 | T-2 (6) | 92 | 2.0 | 2 | Comp. |
| II-7 | 0.5 | $1 \times 10^{-6}$ | 75 | T-2 (6) | 80 | 2.0 | 2 | Comp. |
| II-8 | 0.5 | $1 \times 10^{-6}$ | 100 | T-2 (6) | 100 | 1.5 | 2 | Comp. |
| II-9 | 0.5 | $1 \times 10^{-6}$ | 95 | T-2 (2) | 106 | 2.0 | 2.25 | Comp. |
| II-10 | 0.5 | $1 \times 10^{-6}$ | 95 | T-2 (1) | 107 | 2.0 | 3.5 | Inv. |
| II-11 | 0.5 | $1 \times 10^{-6}$ | 95 | T-2 (0.5) | 107 | 2.1 | 4.5 | Inv. |
| II-12 | 0.5 | $1 \times 10^{-6}$ | 95 | T-4 (0.5) | 107 | 2.1 | 4.5 | Inv. |
| II-13 | 0.5 | $1 \times 10^{-6}$ | 95 | T-12 (0.5) | 108 | 2.1 | 4.75 | Inv. |
| II-14 | 0.5 | $1 \times 10^{-6}$ | 95 | T-12 (0.5) | 110 | 2.1 | 5 | Inv. |

As can be seen from the Table, inventive samples were proved to have high sensitivity and high contrast (γ) even when exposed to semiconductor laser of 780 nm and be superior in silver image tone.

Example 3

Samples III-1 to III-14 were respectively prepared in the same manner as Sample II-1 to 14 in Example 2, except that a sensitizing dye was replaced by exemplified dye III-1 (85 mg/Ag mol). Samples were evaluated with respect to sensitivity, γ and silver image tone in the same manner as in Example 1. Results thereof are summarized in Table 3.

TABLE 3

| Sample No. | I Content (mol %) | Ir Content (mol/mol Ag) | (100) ratio (%) | AZAINdene compound (mol/mol Ag) | Sensitivity | γ | Silver image tone | Remark |
|---|---|---|---|---|---|---|---|---|
| III-1 | 2 | 0 | 95 | T-2 (6) | 114 | 1.3 | 2 | Comp. |
| III-2 | 1 | $1 \times 10^{-6}$ | 95 | T-2 (6) | 107 | 1.9 | 2 | Comp. |
| III-3 | 0.5 | $1 \times 10^{-6}$ | 95 | T-2 (6) | 100 | 2.0 | 2 | Comp. |
| III-4 | 0.1 | $1 \times 10^{-6}$ | 95 | T-2 (6) | 99 | 2.0 | 2 | Comp. |
| III-5 | 0.5 | 0 | 95 | T-2 (6) | 85 | 1.4 | 2 | Comp. |
| III-6 | 0.5 | $1 \times 10^{-6}$ | 85 | T-2 (6) | 93 | 2.0 | 2 | Comp. |
| III-7 | 0.5 | $1 \times 10^{-6}$ | 75 | T-2 (6) | 81 | 2.0 | 2 | Comp. |
| III-8 | 0.5 | $1 \times 10^{-6}$ | 100 | T-2 (6) | 100 | 1.4 | 2 | Comp. |
| III-9 | 0.5 | $1 \times 10^{-6}$ | 95 | T-2 (2) | 108 | 2.0 | 2.25 | Comp. |
| III-10 | 0.5 | $1 \times 10^{-6}$ | 95 | T-2 (1) | 109 | 2.0 | 3.5 | Inv. |
| III-11 | 0.5 | $1 \times 10^{-6}$ | 95 | T-2 (0.5) | 109 | 2.1 | 4.5 | Inv. |
| III-12 | 0.5 | $1 \times 10^{-6}$ | 95 | T-4 (0.5) | 109 | 2.1 | 4.5 | Inv. |
| III-13 | 0.5 | $1 \times 10^{-6}$ | 95 | T-12 (0.5) | 110 | 2.1 | 4.75 | Inv. |
| III-14 | 0.5 | $1 \times 10^{-6}$ | 95 | T-12 (0.5) | 112 | 2.1 | 5 | Inv. |

As can be seen from the Table, inventive samples were proved to have high sensitivity and high contrast (γ) and be superior in silver image tone.

What is claimed is:

1. A silver halide photographic light sensitive material comprising a support having on at least one side thereof a silver halide emulsion layer containing silver halide emulsion, wherein said silver halide emulsion comprises cubic silver halide grains containing iodide of 0.1 to 1.0 mol % and an iridium salt of $1\times10^{-8}$ to $1\times10^{-5}$ mol per mol of silver halide and having an area ratio of (100) face to the total grain surface of 80 to 98%; said silver halide emulsion containing an azaindene compound of not more than 1 mmol per mol of silver halide and being spectrally sensitized with a sensitizing dye represented by formula (I), (II) or (III):

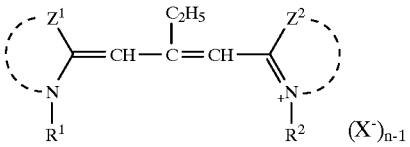

wherein $Z^1$ and $Z^2$ each represent an atomic group necessary for forming a benzothiazole nucleus, benzoselenazole nucleus, naphthothiazole nucleus or naphthoselenazole nucleus; $R^1$ and $R^2$ each represent an alkyl group; $X^-$ represents an ion; and n is 1 or 2, provided that when an intramolecular salt is formed, n is 1;

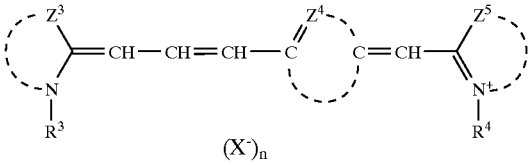

wherein $Z^3$ and $Z^5$ each represent an atomic group necessary for forming a benzothiazole nucleus, benzoselenazole nucleus, naphthothiazole nucleus or naphthoselenazole nucleus; $Z^4$ represents an atomic group necessary for forming a 5 or 6-membered carbon ring; $R^3$ and $R^4$ each represent an alkyl group; $X^-$ represents an ion; and n is 0 or 1;

Formula (III)

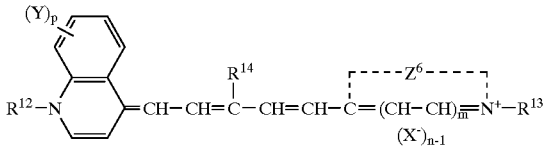

wherein $Z^6$ represents an atomic group necessary for forming a 5 or 6-membered nitrogen-containing ring; Y represents a halogen atom, an alkoxy group or an alkyl group; $R^{12}$ and $R^{13}$ each represent an alkyl group; $R^{14}$ represents a hydrogen atom, an alkyl group, an alkoxy groups, a phenyl group or a benzyl group; $X^-$ represents a counter ion; and m, n and p each represent 1 or 2, provided that when an intramolecular salt is formed, n is 1.

2. The silver halide photographic material of claim 1, wherein said silver halide grains contains iodide of 0.1 to 0.6 mol %.

3. The silver halide photographic material of claim 1, wherein said silver halide grains comprise a (100) face and (111) face, having an area ratio of the (100) face to the total grain surface of 80 to 98%.

4. The silver halide photographic material of claim 3, wherein the area ratio of the (100) face to the total grain surface is 85 to 95%.

5. The silver halide photographic material of claim 1, wherein said azaindene compound is represented by the following formula (T):

formula (T)

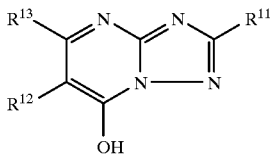

wherein $R^{11}$ represents a hydrogen atom, a carboxyl group, a mercapto group, an aryl group, an alkylthio group or an alicyclic group; $R^{12}$ represents a hydrogen atom, a carboxyl group, an alkylthio group, a heterocyclic group or an alicyclic group; $R^{13}$ represents a hydrogen atom, a hydroxy group, a carboxyl group, an alkylthio group, a heterocyclic group or an alicyclic group, provided that $R^{12}$ and $R^{13}$ may combine with each other to form a heterocyclic ring or carbon ring.

6. The silver halide photographic material of claim 1, wherein said dye represented by formula (II) is represented by the following formula (IIa) or (IIb):

formula (IIa)

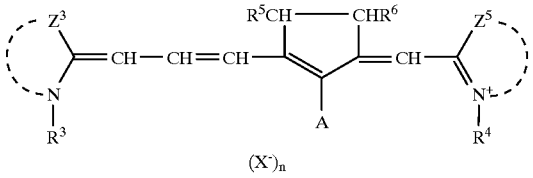

wherein A represents

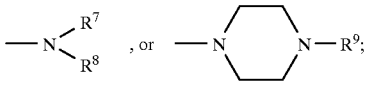

$R^5$ and $R^6$ each represent a hydrogen atom, an alkyl group having 1 to 4 carbon atoms, an alkoxy group having 1 to 4 carbon atoms or a halogen atom; $R^7$ and $R^8$ each represent an alkyl group having 1 to 12 carbon atoms, a phenyl group or an alkoxycarbonylalkyl group in which the alkoxy group has 1 to 4 carbon atoms; $R^9$ represents an alkyl group having 1 to 12 carbon atoms, an alkoxy group having 1 to 4 carbon atoms or an alkoxycarbonyl group in which the alkoxy group has 1 to 4 carbon atoms; $Z^3$, $Z^5$, $R^3$, $R^4$, $X^-$ and n are each the same as defined in formula (II):

formula (IIb)

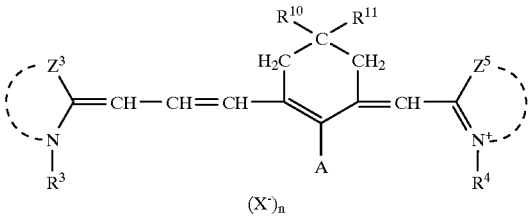

wherein $R^{10}$ and $R^{11}$ each represent a hydrogen atom, an alkyl group having 1 to 4 carbon atoms or a phenyl group; $Z^3$, $Z^5$, $R^3$, $R^4$, $X^-$ and n are each the same as defined in formula (II).

* * * * *